United States Patent [19]

Healey et al.

[11] 4,027,302

[45] May 31, 1977

[54] DOUBLE DETECTION CIRCUIT FOR CONSERVING ENERGY IN FIRE DETECTION SYSTEMS AND THE LIKE

[75] Inventors: William E. Healey; Morse R. Heineman, both of Bloomfield Hills; Ricky M. Erlich, Southfield, all of Mich.

[73] Assignee: W. E. Healey & Associates, Inc., Bloomfield Hills, Mich.

[22] Filed: June 3, 1976

[21] Appl. No.: 692,584

[52] U.S. Cl. ..... 340/227 R; 340/227.1; 340/237 S; 340/418

[51] Int. Cl.[2] ..... G08B 17/00

[58] Field of Search ..... 340/227 R, 227 C, 227 D, 340/227.1, 229, 230, 232, 228 R, 228 F, 228 S, 228.1, 228.2, 233, 418, 223, 420, 237 S

[56] References Cited

UNITED STATES PATENTS

| | | | |
|---|---|---|---|
| 3,380,045 | 4/1968 | Lindberg | 340/227 R |
| 3,603,973 | 9/1971 | Hough | 340/227 R |
| 3,653,016 | 3/1972 | Cormier | 340/228 R |

*Primary Examiner*—Glen R. Swann, III
*Attorney, Agent, or Firm*—Cullen, Settle, Sloman & Cantor

[57] ABSTRACT

A highly sensitive first stage fire detector which does not use the system's battery power responds to the detection of a predetermined condition indicative of a possible fire in a protected area to energize a relay. The relay closes a first switch to supply battery power to a relatively more accurate, battery-powered, second stage detector and if the second stage detector verifies or affirms the existence of an actual fire, an alarm may be initiated or a fire-extinguishing system discharged, as desired. Since only the second stage detector draws power from the battery, it is normally kept isolated to conserve its charge unless the first stage detector energizes the relay. The circuit may also include a latching timer which insures that the relatively more accurate second stage detector has sufficient time to verify or disaffirm the existence of a fire even if the first stage detector were to immediately return to its normal condition.

15 Claims, 7 Drawing Figures

FIG. 1
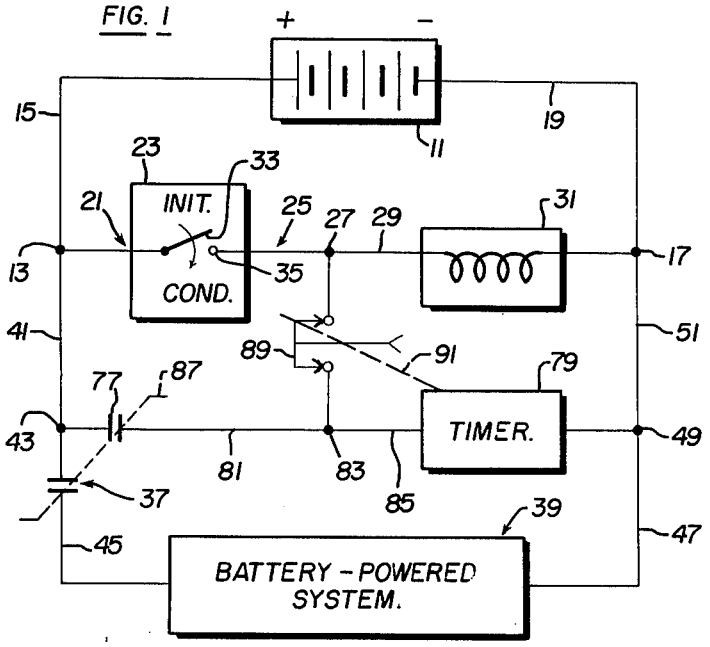
FIG. 5
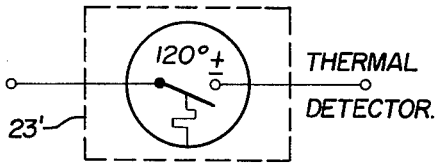
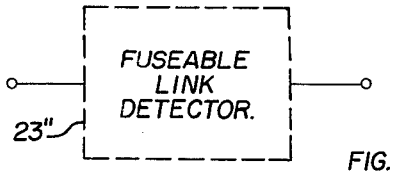
FIG. 6
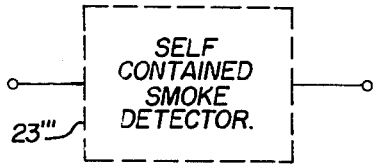
FIG. 7
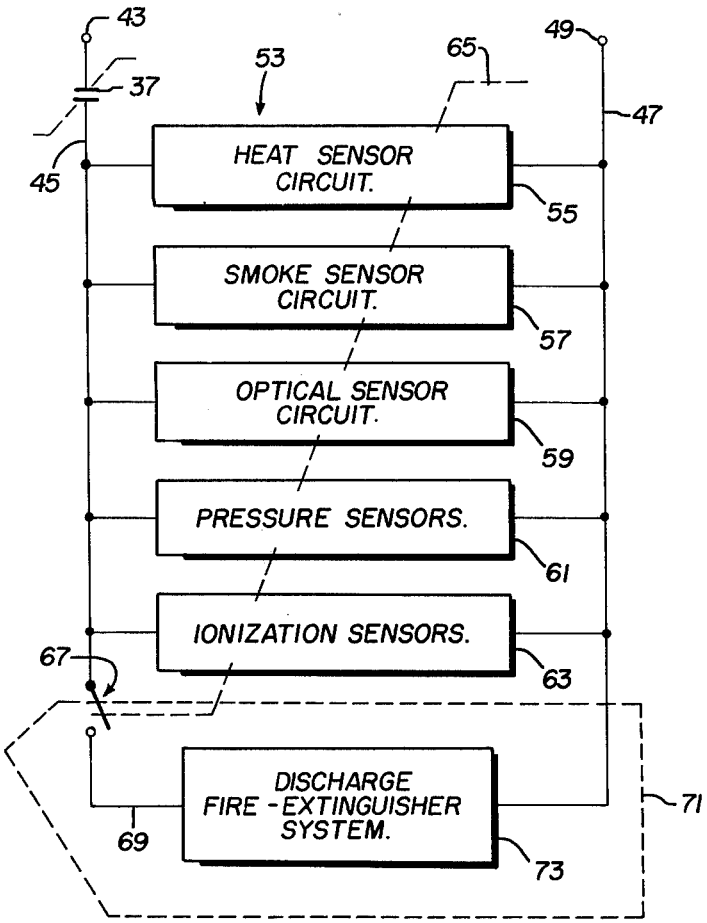
FIG. 2
FIG. 3
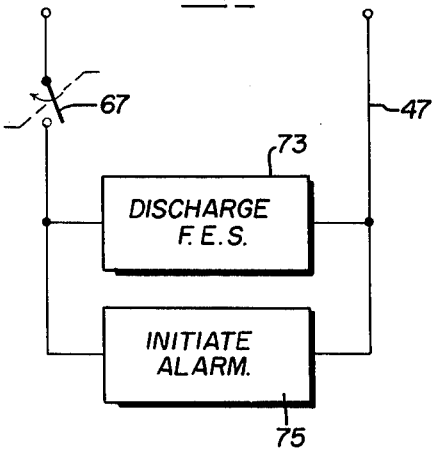
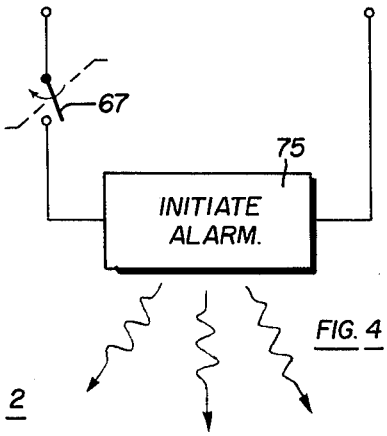
FIG. 4

DOUBLE DETECTION CIRCUIT FOR CONSERVING ENERGY IN FIRE DETECTION SYSTEMS AND THE LIKE

BACKGROUND OF THE INVENTION

This invention relates to fire detection systems and more particularly to a two stage detection circuit for conserving energy in a battery-operated fire detection system or the like.

The prior art contains many different types of fire detection, fire alarm, and fire-extinguishing systems. Many of these systems run on AC power and many others utilize AC power which is converted into rectified DC power used to operate the detection elements, the alarm-initiating devices, and/or the fire-extinguishing discharge or release.

Many areas exist where no AC power is available such as in remote wilderness cabins, motor vehices of all types, shipping enclosures or containers, and the like. Similarly, many applications exist wherein battery-powered systems may be used a back-ups where power may be interrupted for long periods of time such as in buildings, warehouses, factories and the like, particularly those facilities located in areas subject to prolonged power failures. In all of such circumstances, a reliable, battery-operated fire detection system is required.

The prior art has devised many such battery-operated fire detection systems, or battery-operated systems for detecting various other types of alarm conditions. But, in nearly all such systems, the batteries ae relatively short-lived since power must be continually applied to the detection system and continually available to discharge or release the fire-extinguishing fluid or transmit the alarm signal. Some systems utilize relatively expensive, sophisticated battery systems but these are not generally feasible for widespread commercial use.

Additionally, all such systems waste a tremendous amount of electrical energy since the detection system and the alarm activation system or fire-extinguishing release system associated therewith represent a significant and continuous drain on the system. All of this energy is wasted and, should the battery become drained, the fire detection system could fail if a fire developed after the battery became dead or too weak to supply the necessary energy.

A few systems have been developed which utilize detection elements which do not require a separate source of power, but these devices have generally proved to be too sensitive and unreliable for accurate use. Most of these systems will not meet Underwriters Laboratory standards and are subject to frequent false alarms and/or to the expensive, erroneous and sometimes embarrassing release or discharge of fire-extinguishing fluids under false alarm conditions. Additionally, while some of the detectors can operate without a separate source of power, the means for discharging the fire-extinguishing system or for transmitting some type of alarm signal is severely limited unless it also is supplied with a separate battery or source of power.

In summary, the prior art systems either employ relatively reliable battery-powered detectors which cause a continuous drain on the battery thereby shortening its life, and wasting power; or they are relatively unreliable, overly-sensitive and subject to false alarms and expensive erroneous discharges.

The double detection circuit of the present invention solves all of the problems of the prior art and avoids all of its short-comings by providing a highly reliable, battery-operated detection system which does not represent a continuous drain on the battery but which is only activated after an initial or primary fire-indicative condition has been detected by a relatively sensitive, passive detection element.

BRIEF SUMMARY OF THE INVENTION

The present invention is a double detection circuit for use in highly reliable battery-powered fire detection systems or the like for conserving energy and greatly prolonging the life of the battery.

A highly sensitive initial or first stage detector which does not use the systems battery power is able to respond to the detection of a predetermined condition indicative of a possible fire in a protected area to energize a relay. The relay closes a first switch to connect a normally-isolated battery to a relatively less sensitive, highly accurate, battery-powered, second stage detector system for powering the same. If the second detector verifies or affirms the existence of an actual fire, then an alarm may be initiated or a conventional fire-extinguishing system discharged or released, as desired. Since only the second stage detector draws power, the battery is normally kept isolated to conserve its charge unless the first stage detector energizes the relay which closes the switch to supply the power needed to operate the second stage detection system.

The circuit may also include a latching timer which is activated upon energization of the relay. The timer insures that the relatively accurate second stage detector has sufficient time to affirm or disaffirm the existence of an actual fire even if the first stage detector were to immediately return to its normal non-alarm indicating state thereby providing a high degree of reliability with no complexity.

The present invention provides a simple, inexpensive, fail-safe, easy to install and maintain circuit for powering battery-operated fire detection systems and the like in areas where no AC power is available and in areas where a DC backup is required during long periods of AC power interruption.

Another feature of the present invention is that it minimizes the energy dissipated by the battery since the battery remains isolated from the circuit until a preliminary indication of an alarm condition is made. Therefore, the present invention represents a significant advance in energy conservation; greatly prolongs the life of the batteries used to power such systems; and greatly minimizes situations in which a fire is undetected or unsuppressed because the battery has gone dead for lack of sufficient power to respond properly.

It is another feature of this invention to provide a highly reliable fire detection system which offers the best advantages of powered and non-powered detectors and employs a two stage or double detection technique so as to achieve, simultaneously, a high degree of reliability while minimizing power consumption. The present invention greatly minimizes false alarms and inadvertent discharges or release of the fire-extinguishing fluids or agents thereby saving considerable time, expense, system down time and system distrust which have resulted from such failures in the past and allow the present system to meet the standards established by Underwriters Laboratories, Factory Mutual and the like.

The combination of the two stage detection system with its improved reliability and the greatly prolonged life of the battery together with the insured double check capability provided by the timer should the first stage detector immediately return to a safe indication over-comes the problems inherent in the prior art while simultaneously conserving energy and reducing the complexity, expense, and unreliability of the prior art systems.

BRIEF DESCRIPTON OF THE DRAWINGS

Other advantages and meritorious features of the present invention will be more fully understood from the following detailed description of the drawings and the preferred embodiment, the appended claims and the drawings in which:

FIG. 1 represents a schematic diagram, partly in block form, of the double detection system of the present invention;

FIG. 2 is a schematic representation of the second stage of battery-operated detectors and an associated fire-extinguishing discharge or release system which are represented by block 39 of FIG. 1;

FIG. 3 is a block diagram representation of an alternate embodiment of the action-initiating means indicated by block 73 of FIG. 2;

FIG. 4 is a block diagram of yet another alternate embodiment of the action-initiating means represented by block 73 of FIG. 2;

FIG. 5 is a schematic illustration of a 120° thermal detector usable as the passive first stage fire detecting element of block 23 of FIG. 1;

FIG. 6 represents a block diagram of a fuseable link detector which could be utilized as the passive first stage fire-detecting element of block 23 of FIG. 1; and FIG. 7 represents a block diagram of a conventional self-contained smoke detector which can be utilized as the passive first stage fire-detecting element of block 23 of FIG. 1.

DESCRIPTION OF THE PREFERRED EMBODIMENT

FIG. 1 represents a schematic diagram, partially in block form, of the double detection or two-stage fire detecting system of the prime embodiment of the present invention. A source of DC electrical potential is represented by the battery 11. The battery 11 typically represents a conventional storage battery of the type used in battery-powered fire detection systems, and, in the present example, is a 24 volt battery although 12 volt, 36 volt and 48 volt batteries have also been tested and found successful in various systems. The positive terminal of the battery 11 is connected to node 13 via electrical conductor or lead 15 and the negative terminal of the battery 11 is connected to node 17 via conductor or lead 19. A first series circuit path is connected between the node 13 and the node 17 as follows. Node 13 is connected directly to the input 21 of a relatively sensitive, passive first stage detector element represented generally by the block 23. The output 25 of the block 23 is connected directly to a node 27 and then via lead 29 to the input of a relay coil 31 whose output is connected directly to the node 17.

The first stage or passive fire detection element represented by block 23 generally includes a normally-opened switch 33 and a contact 35. The first fire-detecting element 23 is referred to herein as the initial first stage, or passive detector. It is totally passive and requires no electrical energy whatsoever for the system battery 11. The nature of the first detecting element 23 is such that it responds to the existence of a predetermined condition indicative of the possible existence of a fire or some form of combustion within a given area to be protected and closes the switch 33 on the contact 35 in response thereto. Any type of passive detection element which does not require power from the battery 11 could be used in block 23 and, as indicated in FIGS. 5, 6 and 7, the first detection element of block 23 could be represented by a conventionally known 120° thermal detector as indicated in block 23′ in FIG. 5; by a self-restoring or resettable fuseable link fire detector as represented by block 23″ in FIG. 6; or by a conventionally known self-contained smoke or products of combustion detector as illustrated by block 23‴ of FIG. 7. The self-contained smoke detector of FIG. 7 generally includes a small self-contained long-lasting battery which does not depend upon system power and which may last for several years and hence may be considered, for the purposes of this invention, as a passive device. The thermal detector 23′ of FIG. 5 represents the preferred embodiment of the example described herein.

The battery 11 and the first series combination of the first detector element 23 and the relay 31 form a first electrical circuit loop which originates at the positive terminal of the battery 11 and then proceeds via lead 15, node 13, input 21, the first passive detection element 23, output 25, node 27, lead 29, relay 31, node 17, and then via lead 19 back to the negative terminal of the battery 11. In operation, the normally-opened switch 33 contained within the first detection element 23 normally disconnects or isolates the battery 11 from the relay 31 by causing a break or open circuit within the first loop. However, the nature of the first detection element, whether it be the embodiment of FIGS. 5, 6 or 7 or some other conventional detector devices, is such that the switch 33 or some counterpart thereto closes upon the contact 35 to complete an electrical path between the input 21 and the output 25 of the passive device 23 thereby completing the electrical circuit of the first loop to the battery 11 and causing electrical current to flow through the first series circuit to energize the relay coil 31.

The circuit of FIG. 1 also includes a second series circuit comprising the combination of a first normally-opened relay-operated switch or pair of relay-operated contacts 37 and a battery-powered second stage system represented generally by block 39 which includes a highly reliable battery-operated detection means of the second stage or second level of detection used in the circuit of the present invention.

The second series circuit comprising the combination of the first switch 37 and the battery-powered system 39 is connected into a second electrical circuit loop with the battery 11 in the following manner. The positive terminal of the battery 11 is connected through the lead 15 to node 13. Node 13 is connected via lead 41 to a node 43. Node 43 is connected to the input of the first relay-operated switch 37 whose output is connected via lead 45 to the input to the battery-powered system of block 39. The output of the system of block 39 is connected via lead 47 to a node 49 which is, in turn, connected via lead 51 to the node 17 which is connected via lead 19 to the negative terminal of the battery 11 thereby completing the second circuit loop.

As illustrated in FIG. 2, the second stage or second level of detectors of block 39 are represented generally by the reference numeral 53. Actually, the relatively reliable, battery-operated detector or sensor elements or circuits contained within the second stage 53 are conventionally known. The second stage 53 may include, for example, a heat or thermal sensor switch, element or device as indicated by block 55; a smoke or products of combustion sensor or circuit as indicated by block 57; an ultraviolet or other type of optical sensor element or circuit as indicated by block 59; a pressure-sensing device or pressure differential sensor as indicated by block 61; an ionization or particle sensing device or element as represented by block 63 or any other similar conventionally known device for sensing the existence or impending existence of some type of combustion including fire.

Each of these devices 55, 57, 59, 61, and 63 have their inputs coupled to the input 45 and their outputs coupled to the output 47. It will be understood that the second detector stage 53 may include a single one of the sensors described hereinabove; any number of one type of the sensors; or any mixture of numbers and types as known in the art.

Each of the second detector elements 55, 57, 59, 61, and 63 operate in such a manner so as to monitor the area to be protected for one or more various conditions indicative of the existence of a fire or some similar type of combustion to generate an electrical signal indicative thereof. The dotted line 65 symbolically represents the generation of the indicative electrical signal and the signal-operated switch 67 symbolically represents positive action being initiated in response thereto. This action, represented by the closure of switch 67, supplies power to conventionally known action-initiating circuitry represented by the dotted block 71 of FIG. 2.

In practice, the closure of switch 67 supplies battery power from the input 45 through the closed switch 67 and lead 69 to the input of the discharging or releasing block 73 whose output connects directly to the battery-powered system output 47. Block 73, in the embodiment of FIG. 2, contains a conventionally known discharging or releasing mechanism for a fire-extinguishing system or fire suppressant system. For example, the embodiment of FIG. 2 including the second stage 53 of battery-powered detectors and the battery-powered discharge-initiating means of block 73 is typical of some of the commercially available systems such as the 24 volt detector-releasing fire suppressant system manufactured by Fenwal.

An alternative to the action-initiating means of block 71 is illustrated in FIG. 3 wherein the closing of the symbolic switch 67 in response to an affirmation or verification made by the second level of detectors 52 supplies DC power from the battery 11 to both a fire extinguishing system discharging or releasing device as indicated by block 73 and simultaneously to a conventionally-known alarm-initiating circuit represented by the block 75. For example, the power could be used to transmit an alarm signal to a central monitoring station over normal telephone lines; to drive a motor to dial a pre-recorded number and transmit a coded message to a fire station or the like; to broadcast a pre-recorded message over a radio link; to turn on an annunciating device, visual sign or siren; or any similar type of conventionally known alarm signalling means. Additionally, a conventional latching circuit could be employed in block 71 to insure that the alarm remains initiated even after the fire has been suppressed.

FIG. 4 represents still another embodiment of the action-initiating means of block 71 of FIG. 2 wherein only the alarm-initiating means of block 75 of FIG. 3 is used. Regardless of the nature of the alarm signal initiated or the action taken by the second level of detectors 53, the actual circuits and elements used in the battery-powered system are conventionally known and commercially available from any number of sources and their specific structure no part of the present invention.

In operation, the normally-opened, relay-operated switch 37 keeps the battery-powered system of block 39 disconnected or isolated from the storage battery 11 so that it represents no drain on the battery thereby conserving energy and prolonging the life of the battery. When the relay 31 is energized in response to the closure of the switch 23 in response to the passive first element having detected a possible fire, the relay-operated switch 37 is closed thereby completing the electrical path of the second circuit loop and supplying battery power to the battery-operated second stage or level of detectors 53 as represented in FIG. 2.

A third series circuit comprises the combination of a second normally-opened, relay-operated switch 77 and an electrical timing device 79. The third series circuit is connected to the battery 11 to form a third electrical circuit loop extending from the positive terminal of the battery 11 through the lead 15, node 13, lead 41, node 43, and then directly to the first contact of the second switch 77 whose output is connected via lead 81 to a node 83 which is connected via lead 85 to the input of an electrical timer 79 whose output is connected directly to the node 49. Node 49 is connected via lead 81 to node 17 which is connected via lead 19 to the negative terminal of the battery 11 to complete the third circuit loop.

In operation, the second normally-opened switch 77 normally keeps the battery 11 disconnected or isolated from the electrical timer 79 to conserve energy and prolong the life of the battery 11. When the relay-operated switch 77 closes in response to the energization of relay 31, as heretofore described, and as represented by the dotted line 87, electrical energy is supplied to the timer 79 causing it to activate. Any type of conventionally known timer may be used which continually recycles over a predetermined timing interval so long as power is applied thereto. In the present example, an AGASTAT 7000 timer was used. The timing interval may be adjusted over a wide range, for example from several seconds to an hour or more but, in typical applications, it is normally set for a range of from 10 to 30 minutes. If the second switch 77 is opened in response to the deenergization of the relay 31, electrical current to the timer 79 will be terminated and it will immediately cease operation.

A third normally-closed timer-operated switch 89 is connected between the junction 83 which is located between the second normally-opened relay-operated switch 77 and the input to the timer 79 of the third series circuit and the junction 27 which is located between the output 25 of the first passive detector 23 and the input of the relay 31 so as to provide a fourth alternate circuit loop in series with the battery 11. The alternate loop originates at the positive terminal of the battery 11 and then proceeds via lead 15, node 13, lead 41, node 43, the second switch 77, lead 81, node 83, the third normally-closed timer-operated switch 89, node 27, lead 29, relay 31, node 17, and lead 19 back to the negative terminal of the battery 11 to complete the fourth alternate circuit loop.

The purpose of the fourth alternate or latching loop is as follows. In operation, due to the extreme sensitivity of the first passive detector of block 23, the situation may arise wherein immediately after the switch 33 has closed on the contact 35 in response to the detection of a condition indicative of a possible fire, it may immediately reopen signalling that no alarm condition exists. Under such circumstances, the less sensitive and highly reliable battery-powered detectors of the second stage 53 will not have power because the reopening of the switch 33 will normally deenergize the relay 31 thereby reopening the first relay-operated switch terminating the flow of power to the battery-powered system of block 39.

Therefore, power will be provided through the alternate loop to maintain the relay coil 31 energized to insure the supply of battery power to the second detector stage 53 for some predetermined period of time after the first detector element 23 has reopened. The length of said predetermined period of time is equal to the time remaining in the predetermined timing interval currently being cycled by the timer 79 since the third timer-operated switch 89 remains normally-closed until the termination of the given timing interval. At that time, as indicated by the dotted line 91, the timer 79 will cause the third switch 89 to momentarily open thereby disconnecting the battery 11 from the relay coil 31 and causing its deenergization. The deenergization of the relay coil 31 will cause the first and second relay-operated switches 37 and 77 to open to terminate the flow of power to the battery-powered system of block 39 and to again isolate the battery 11 to conserve energy and prolong the life thereof.

Therefore, the two-stage or double detection feature of the present invention insures that the battery 11 is normally isolated from the battery-powered detectors 53 so that no power is dissipated under normal conditions. Only after the highly sensitive, initial detector 23, which draws no battery power from the system, senses a possible fire is power supplied to the relatively more reliable battery-operated sensors 53 and an accurate determination as to whether or not fire actually exists, is made. If it is determined that a fire actually exists, the power may be used to discharge or release a fire-extinguishing or suppressing agent or to generate an alarm or both. The timer insures that a proper determination is made even if the relatively unreliable passive detector 23 should immediately reopen and indicate the absence of an alarm condition. The combination of the present invention results in a relatively simple, inexpensive, highly reliable, energy-conserving fire detection system which has an extremely long battery life and which results in a minimum of false alarms.

While the prime embodiment of the present invention has been disclosed with reference to a fire detection system, it will, of course, be recognized that other applications employing the principles disclosed herein would similarly be covered by the inventive concept of this invention.

With this detailed description of the specific apparatus used to illustrate the prime embodiment of the present invention and the operation thereof, it will be obvious to those skilled in the art that various modifications can be made in the circuit, in the nature of the detectors used therein, and in the applications to which the circuit is put without departing from the spirit and scope of the present invention which is limited only by the appended claims.

We claim:

1. A battery-operated, energy-conserving fire detector system comprising:

a relatively sensitive, passive fire detection element requiring no system power for operation and responsive to the detection of a predetermined condition indicative of combustion in a protected area for closing a normally-opened electrical path between its input and its output;

a D.C. storage battery for supplying system power having one terminal coupled to the input of said passive fire detection element;

relay means coupling the output of said passive fire detection element to the opposite terminal of said battery to form a first circuit loop; said relay means being energized in response to the passage of current therethrough when said passive element closes said path to complete said first circuit loop;

a non-passive, highly reliable, battery-powered fire detection means for more accurately monitoring said area to be protected for at least one, predetermined condition indicative of combustion within said protected area and responsive to the detection of said at least one predetermined indicative condition for generating a verification signal indicative thereof;

a battery-powered, action-initiating means coupled to said non-passive fire detection means and responsive to the generation of said verification signal for electrically initiating a predetermined positive corrective action;

conductive means coupling said non-passive fire detection means into a second circuit loop with said battery; and a first normally-opened relay-operated switch interposed in said second circuit loop and responsive to the energization of said relay means for closing its contacts to complete said second circuit loop and supply power to said non-passive fire detection means and responsive to the de-energization of said relay means for opening its contacts to break said second circuit loop and cut off the flow of power to said non-passive fire detection means such that said battery is only connected to the energy-consuming, non-passive fire detection means after an initial detection by said passive element thereby conserving energy and prolonging the life of the battery.

2. The fire detector system of claim 1 further including the series combination of a second normally-opened, relay-operated switch and a timing means coupled in a third circuit loop with said battery, said second relay-operated switch being responsive to the energization of said relay means for closing its contacts to supply battery power to said timing means and being responsive to the de-energization of said relay means to open its contacts and turn off said timing means, said timing means being responsive to the application of power thereto for continually re-cycling over a predetermined time interval; said fire detection system further including a timer-responsive switching means coupled between the junction of said second relay-operated switch and said timing means and the output of said passive element so as to form an alternate circuit loop including said battery, said timer-responsive switching means and said relay means, said timer responsive switching means being normally closed, to complete said alternate circuit loop while said timing means is within its predetermined timing cycle but being responsive to the termination of each complete timing interval for momentarily opening to open circuit said alternate circuit loop such that if said passive fire detection element were to momentarily close said electrical path to energize said relay means and then immediately open before said non-passive fire detection means could complete its more accurate monitoring, said alternate circuit loop will maintain said relay means energized to power said battery-powered detector means even after said non-passive fire detection element has open circuited said path until said timing means completes its current predetermined timing interval and opens said timer-responsive switching means to de-energize said relay means thereby opening said first and second relay-operated switches to again isolate the battery from all of the circuit loops.

3. The fire detector system of claim 1 further characterized in that said action-initiating means causes a fire-extinguishing system to discharge its fire-suppressing agent.

4. The fire detector system of claim 1 further characterized in that said action-initiating means causes a fire alarm signal to be transmitted.

5. The fire detector system of claim 1 further characterized in that said highly reliable, non-passive, battery powered fire detection means and said action-initiating means are combined into a battery-powered fire detection-fire suppression system.

6. The fire detector system of claim 1 further characterized in that said non-passive, battery-powered fire detection means includes at least one of a thermal or heat-detecting element, a smoke or products of combustion detecting element, an ultraviolet or other optical detecting element, a pressure sensing element and an ionization detecting element.

7. The fire detector of claim 1 wherein said passive fire detection element includes a normally-opened, thermal-responsive switching element.

8. The fire detector system of claim 1 wherein said passive fire detection element includes a restoreable thermally-operated fuseable link.

9. The fire detector system of claim 1 wherein said passive fire detection element includes a self-contained products of combustion detector having its own power source independent of said system battery.

10. In a battery-powered system for reliably detecting the actual existence of a fire or combustion-type condition within an area to be protected and for rapidly discharging a fire-extinguishing or suppressing system in response thereto, the improvement comprising a circuit for conserving energy and prolonging the life of the battery, said circuit including a first series combination of a relatively sensitive detecting means and a relay coupled into a first circuit loop with said battery, said detecting means having a pair of normally-opened contacts for breaking said first circuit loop and maintaining said relay in a de-energized state to isolate said battery to conserve its energy, said detecting means being adapted to monitor for a predetermined condition indicative of the possible existence of a fire or combustion-type condition within the protected area and being responsive thereto for closing said contacts to complete said first circuit loop and energize said relay; a second series combination of a first normally-opened, relay-operated switching means and a relatively more reliable, energy-consuming, battery-powered detection and extinguishing system coupled into a second circuit loop with said battery, said first normally-opened relay-operated switching means normally breaking said second circuit loop to isolate said battery from said battery-powered detection and extinguishing system to conserve energy, said first switching means being responsive to the energization of said relay for closing its contacts to complete said second circuit loop and power said system; a third series combination of a second normally-opened relay-operated switching means and an electrical timing means coupled into a third circuit loop with said battery, said second normally-opened switching means normally breaking said third circuit loop to isolate said battery from said timing means to conserve energy, said second switching means being responsive to the energization of said relay for closing its contacts to complete said third circuit loop and activate said timing means, said timing means operating to continually recycle through a predetermined timed interval so long as said second switching means remains closed to supply power thereto; and a normally closed timer-operated switching means coupled between the junction of said second switching means with said timing means of said third circuit loop and the junction of said relatively sensitive detecting means with said relay of said first circuit loop for forming a fourth circuit loop including said battery, said first and third switching means and said relay for normally latching said relay in its energized state to continue the flow of power to said battery-operated detecting and extinguishing system even if said detecting means has re-opened its contacts until said relatively more reliable battery-powered detecting system has had sufficient time to adequately monitor said protected area, said sufficient time being determined by the timed interval of said timing means such that after said detecting means has re-opened its contacts and said timing means has completed its current timed interval, said third timer-operated switching means will respond thereto for opening its contacts to break said fourth circuit loop to de-energize said relay, re-open said first and second switching means and again isolate said battery to conserve energy and prolong the life thereof.

11. A battery-operated, double detection alarm condition monitoring system comprising:

a battery for supplying electrical power to the system a first series circuit including a relatively high sensitivity first detector element and a relay, said first series circuit being coupled in a first electrical loop with said battery, said first detector element being adapted to monitor for a predetermined condition indicative of a possible alarm state without utilizing any power whatsoever from said battery, said first detector normally maintaining said battery disconnected from said relay to conserve the battery's charge but being responsive to the detection of said indicative condition for connecting said battery to said relay for energizing same; and a second series circuit including a first relay-operated switch and a relatively reliable second detector means which utilizes power from said battery to monitor for a condition indicative of an actual alarm state, said second series circuit being coupled into a second electrical loop with said battery, said first relay-operated switch normally maintaining said battery disconnected from said energy-consuming second detector means to conserve the battery's charge but being responsive to the energization of said relay for connecting said battery to said second detector means for powering same such that said powered second detector means is able to double check the alarm condition determination made by said first detector element for affirming or disaffirming same.

12. The monitoring system of claim 11 further including a third series circuit including a second relay-operated switch and an electrical timing means, said third series circuit being coupled into a third electrical loop with said battery, said second relay-operated switch normally disconnecting said battery from said timing means to conserve the battery's charge but being responsive to the energization of said relay for connecting said battery to said timing means for activating same, said timing means continually recycling through a predetermined timing interval until deactivated by said second relay-operated switch again disconnecting said battery therefrom, and a timer-operated switching means coupling the junction of said second switch and said timing means to the junction of said first detector element and said relay so as to establish a fourth electrical loop including the battery, said first switch, said timer-operated switching means, and said relay for latching said relay in its energized state to insure the supply of battery power to said second detector means for some predetermined period of time after said first detector element has again disconnected said battery from said relay by open circuiting said first circuit loop, the length of said predetermined period of time being equal to the time remaining in the predetermined timing interval currently being cycled by said timing means since timer-operated switching means is responsive to said timing means having completed a given timing interval for opening its contacts to open circuit said fourth loop to de-energize said relay thereby opening said first and second switches to disconnect said battery from all of said loops to isolate same and conserve the charge on the battery.

13. The monitoring system of claim 12 further characterized in that said second detector means is responsive to an affirmation of the existence of an alarm indicative condition for initiating an alarm indication.

14. The monitoring system of claim 13 further characterized in that said first detector element includes a passive combustion detecting means, said second detection means includes a battery-powered combustion detecting mean, and said means initiating an alarm indication contemplates electrically discharging a fire-suppressing system.

15. The monitoring system of claim 13 further characterized in that said alarm indication comprises an audio-visual signal indicative of the existence of an actual alarm state.

* * * * *